United States Patent [19]

Lee

[11] Patent Number: 4,889,246

[45] Date of Patent: Dec. 26, 1989

[54] ROTATING CLOTHES TREE

[76] Inventor: Kil J. Lee, 508 Crocker Ave., Pacific Grove, Calif. 93950

[21] Appl. No.: 317,844

[22] Filed: Mar. 2, 1989

Related U.S. Application Data

[63] Continuation-in-part of Ser. No. 227,084, Aug. 1, 1988, which is a continuation-in-part of Ser. No. 48,324, May 11, 1987, abandoned.

[51] Int. Cl.[4] ..... A47F 5/02

[52] U.S. Cl. ..... 211/163; 211/205

[58] Field of Search ..... 211/163, 205, 131, 133, 211/33, 54.1, 57.1, 59.1, 194, 196; D6/411–415

[56] References Cited

U.S. PATENT DOCUMENTS

| | | | |
|---|---|---|---|
| 48,989 | 7/1865 | Palmenbury . | |
| D. 67,680 | 6/1925 | Ziegler | 211/33 X |
| D. 127,028 | 5/1941 | Warren | D6/413 X |
| 346,293 | 7/1886 | Lavaggi | 211/33 |
| 381,414 | 4/1888 | Parker . | |
| 478,386 | 7/1892 | Wolf . | |
| 649,734 | 4/1900 | Leger . | |
| 922,991 | 5/1909 | Wolf . | |
| 1,358,756 | 11/1920 | Kozlowski . | |
| 1,466,564 | 8/1923 | Samuel . | |
| 3,310,180 | 3/1967 | Neagle | 211/205 |
| 3,315,819 | 4/1967 | Kingsbery . | |
| 3,424,313 | 1/1969 | Feibelman . | |
| 3,547,275 | 12/1960 | Engel | 211/205 |
| 3,788,489 | 1/1974 | Levinthal . | |
| 4,453,640 | 6/1984 | Cillario | 211/194 X |
| 4,582,225 | 4/1986 | Peden et al. . | |

FOREIGN PATENT DOCUMENTS

| | | | |
|---|---|---|---|
| 2019456 | 11/1971 | Fed. Rep. of Germany | 211/205 |

*Primary Examiner*—Alvin C. Chin-Shue
*Assistant Examiner*—Sarah A. Lechok
*Attorney, Agent, or Firm*—William H. Pavitt, Jr.; Ralf H. Siegemund; Vernon D. Beehler

[57] ABSTRACT

A disassembleble clothes or other garment rack or stand having a base, a supporting axle rod extending upwardly from the base and a plurality of spool-like elements separated from each other, and disposed for rotation about the rod at different height levels, and each said element having angularly, upwardly extending peg-type hangers insertable into it, with each of said elements and its hangers being greater in size and extent than the element and its hangers at the level immediately below.

8 Claims, 1 Drawing Sheet

ROTATING CLOTHES TREE

This is a continuation-in-part application of application Ser. No. 07/227,084 filed Aug. 1, 1988, which is a continuation-in-part of application Ser. No. 07/048,324 now abandoned filed May 11, 1987.

FIELD OF THE INVENTION

This invention relates to clothes trees such as would be placed in homes and offices.

BACKGROUND OF THE INVENTION

Various types of hat and coat racks, clothes stands, and clothes trees have been devised since at least the early days of colonies. Subsequent to the American Civil War, some attention was given to providing cloak or clothes stands which would rotate. Examples of such stands may be seen as follows in the early patents to:

| INVENTOR | U.S. Pat. No. |
|---|---|
| J. R. Palmenbury | 48,989 |
| S. A. Parker | 381,414 |
| F. Wolf | 478,386 |
| E. Leger | 649,734 |
| F. Wolf | 922,991 |
| M. Kozlowski | 1,258,756 |
| Leon M. Levinthal | 3,788,489 |

In addition, revolving devices have been provided to support neckties (No. 1,466,564); displays (No. 3,424,313); saddles (No. 3,315,819); and powder dispensers (No. 4,582,225).

Further, in the course of the prosecution of the application Ser. No. 07/048,324, the following additional patents have been cited by the Examiner:

| INVENTOR | U.S. Pat. No. |
|---|---|
| Lavaggi | 346,293 |
| Ziegler | 67,680 |
| Warren | 127,028 |
| Neagle | 3,310,180 |
| Engel | 3,547,275 |
| Schramm (West Germany) | 2,019,456 |
| Cillario | 4,453,640 |

For one reason or another, revolving clothes or coat racks, are seldom, if ever, seen in use today. Conceivably, this could be because devices made of elaborate ironworks, such as are illustrated and described in the patents to Palmenbury (No. 48,989), Parker (No. 381,414), Leger (No. 649,734), and Wolf (No. 922,991), would appear to be both expensive to fabricate, cumbersome to carry and properly locate, and not aesthetically appealing. As a consequence, most clothes trees or clothes racks found today comprise simple vertical wooden members supported by a plurality of legs or some other base, and a plurality of hooking devices radiating from the upper end of, and fastened to the member by screws or bolts. Usually these clothes trees or stands are placed against a wall or in a corner in such a manner that coats or other garments to be hung therefrom, can only be hooked onto one or two sides, and not on the hooks extending toward the wall or the walls against which the stand is placed. It is desirable therefore, to provide for rotation of the hooking elements, as was apparently appreciated more than one hundred years ago.

It is also, however, most important that any revolving clothes tree or stand be both inexpensive to fabricate and assemble, light in weight so that it can be easily moved about in a room or other location, occupy a minimum amount of space, and be pleasing in appearance. It is also desirable from a marketing standpoint for a clothes tree or rack to be packaged compactly in a disassembled state, but easily and securely assembled in whatever place it is to be placed for use.

The prior art falls short of achieving all of these objectives.

SUMMARY OF THE INVENTION

According to the present invention, a vertical base member is provided and supported at its lower end by, preferably, four downwardly and outwardly extending legs secured to such base member. The base member is orificed downwardly from its upper end for a predetermined distance to support a vertically extending cylindrical rod inserted in the orifice. Slipped onto this rod, which serves as an axle, are a plurality of spool-like elements each having a center portion which may be cylindrical or multi-faceted, and being centrally orificed to allow the axle-rod to be passed through its core for rotatable support by and about the axle rod. Desirably spacers should be interposed between each of the spool-like elements. These spacers may be either attached to an adjacent spool-like element, or entirely separated therefrom so as to be independently rotatable from the spool-like elements. The top of the rod may be capped with a knoblike member having an orifice extending upwardly from its lower end to receive the upper end of the rod.

Each of the spool-like elements which are preferably fabricated of wood, may be drilled downwardly at an angle from its side in several locations angularly spaced from each other, and provided with threading into which may be screwed wooden peglike hanger members. The latter will serve as upwardly directed projections adapted to receive either a hanger carrying a garment, or the garment itself directly. Each spool-like element and its peg-like members may be greater in size and extent than the spool-like element and its peg-like members next below it. Thereby, garments hung on the upper peg-like members will not tend to fall on top of garments hung on the lower members, and the former garments may be rotated about the vertical axis of the tree or rack without also necessarily pulling around the garments hung on the lower hanger elements.

It may be thus seen that the present invention provides an exceedingly simple clothes or garment tree or stand, having a plurality of independently rotatable sets of peg hangers. The entire tree or stand may be readily disassembled into, or fabricated as, its several parts. In the latter case, the parts may be conveniently packaged in a relatively small box for assembly by its purchaser. When assembled, the tree or stand will be found to be quite light, so that it may be readily moved into any convenient location. Its several spool-like elements from which the hooking peg members project upwardly, may be rotated into any desired angular disposition. Moreover, because of its extremely simple construction, it is esthetically pleasing even when it is set up by itself and is not carrying any garments.

The clothes tree or stand of the present invention, therefore, obviates many of the features of prior art devices which apparently caused them to be rejected by the public despite the desirability of having hanger rotating capabilities.

DESCRIPTION OF THE PREFERRED EMBODIMENT

Figure 1:
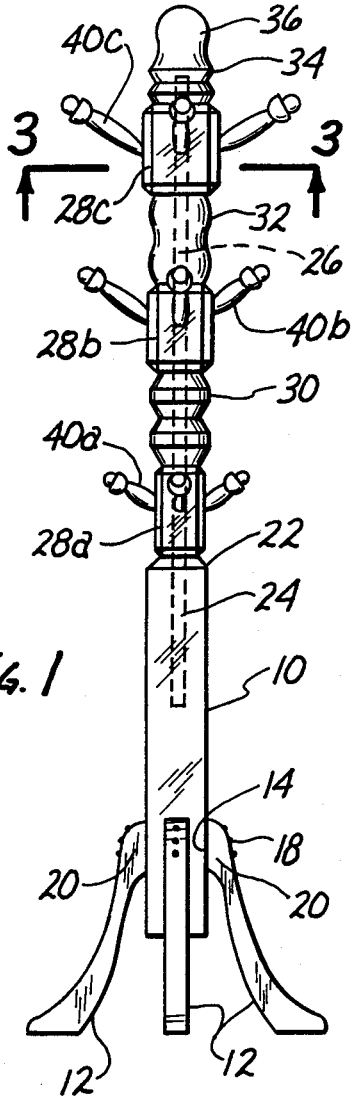
FIG. 1 is a side elevation of the preferred embodiment of the present invention.
Figure 2:
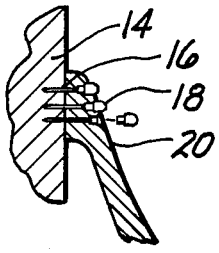
FIG. 2 is an enlarged section of juncture of the base with the right hand leg shown at the base of FIG. 1.

Referring to the drawings, a cylindrical base member 10 is supported by a plurality of legs 12 in an upright position. Desirably, the base member 10 may be fabricated of wood and drilled where each of the upper or head portions 20 of the legs 12 would attach at 14 to the member 10. For secure support, preferably at least three drill holes 16 are provided to receive screws 18 which pass through the head portion 20 of each leg 12.

The upper end 22 of the member 10 is coaxially orificed at 24 for at least a portion of the length of the member 10 to receive an axle rod 26 for support in a vertical orientation. After the axle rod 26 has been dropped into the orifice 24, a plurality of spool-like elements **28*a*, 28*b*, and 28*c* may be slipped onto the rod 26. However, desirably, spacers 30 and 32 should be interposed between adjacent spool-like elements 28*a* and 28*b*, and 28*b* and 28*c*. The spacers 30 and 32 may be of any esthetic configuration and may either be entirely separate from either of the spool-like elements 28*a*, 28*b*, or 28*c*, between which they are interposed, or, if desired, may be attached to one of the adjacent elements 28*a*, 28*b*, or 28*c*, or formed integrally therewith. The dimension of the axle rod 26 in relation to the combined axial dimensions of the spool-like elements 28*a*, 28*b*, or 28*c*, and the spacers 30 and 32, may be such as to leave a small segment 34 at the top of the rod 26 onto which an orificed cap 36** may be placed to provide a finished look for the assembled clothes tree or stand.

Figure 3:
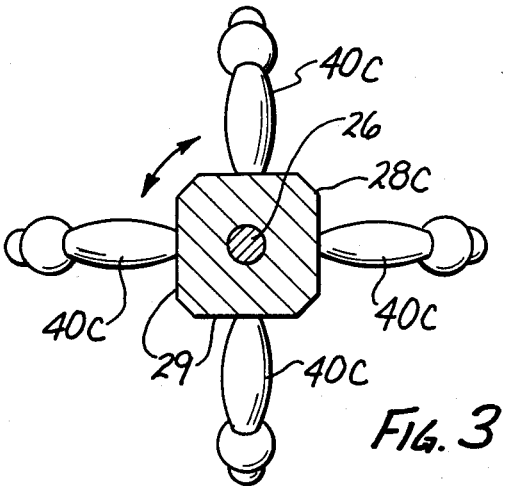
FIG. 3 is a sectional view taken on line 3—3 of FIG. 1 in the direction of the arrows.
Figure 4:
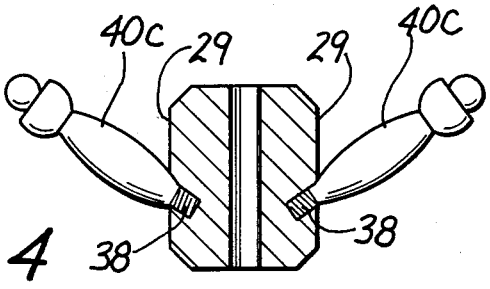
FIG. 4 is a vertical sectional view of the upper rotatable element when removed from the stand combination.

Each of the spool-like elements **28*a*, 28*b*, 28*c* is preferably square or octagonal in cross-section as shown in FIG. 3, thereby to provide a plurality of symmetrically disposed vertical facet walls about the element's axis, although the elements could each be circular in, or of other preferably symmetrical cross-section, without departing from the scope of the present invention. However the side walls of the elements 28*a*, 28*b*, and 28*c* are faceted, each is desirably threadedly drilled at 38 at an upwardly extending angle to receive matingly threaded peg members 40 which serve as coat hooks or hanger hooks. Thus, as shown in FIG. 4, a peg 40 is threaded into each of the four sides 29 of the spool-like elements 28*a*, 28*b*, and 28*c* to extend outwardly and at 90 degree spacing from adjacent pegs 40**.

From the construction thus described and illustrated, it may be readily appreciated that, when assembled, each of the elements 28 may be rotated about the rod 26, thus to enable a garment to be disposed about the rod axis at any point about the assembly. In this connection, it should be noted that it is also a feature of the present invention to provide increasing size and extent of the spool-like elements **28*a*, 28*b*, and 28*c*, and their respective peg members 40, with the rise in the levels of their respective dispositions on the rod 26. Thus, it will be noted that element 28*b* and its members 40*b* are respectively larger than element 28*a* and its members 40*a*; and 28*c* and its members 40*c* are, in turn, respectively larger than 28*b* and its members 40*b***.

As a consequence of this size difference, it will be appreciated that clothes hung on the upper pegs **40*c* will not tend to pile up on the clothes hung on the second tier of pegs 40*b*; nor will those hung on tier 40*b* tend to pile up on the clothes hung on the pegs 40*a*. This arrangement results in a much neater looking coat or garment rack when numerous garments may be placed upon it, as in a restaurant or other public place. In addition, the clothes hung on each spool-like element 28*b*, 28*c*, and its respective peg members 40*b*, 40*c* may be rotated without necessarily causing clothes hanging on the lower peg members 40*a*, 40*b*** also to be rotated.

By virtue of the construction of the clothes rack of the present invention, it will also be readily appreciated that the whole device may be packed in a box no longer than the length of the axial rod 26. The height and width of the box may also be kept quite small since the various parts may be separately fabricated and assembled for packing, and include only the base member 10, the legs 12, the spool-like members **28*a*, 28*b*, and 28*c* with their respective detached peg elements 40*a*, 40*b*, and 40*c*, the spacers 30 and 32, and the cap 36**. Because of such convenience in packing and easy assembly to produce a simple aesthetically appearing clothes or garment rack or tree, the assembly of the present invention will have great marketability and utility, and will be readily accepted by the public which appears long ago to have rejected rotating clothes racks described and illustrated in the prior art patents, such as have been hereinabove referred to in this specification.

I claim:

1. A clothes stand comprising:

(a) a base member, said member being at least partially axially orificed, from its top downwardly, said base member including means to support said base member on a horizontal surface with the axis of said orifice in a substantially vertical orientation;

(b) a cylindrical axle rod, said rod having a portion of a configuration to fit into the orifice in said base member, and being inserted therein;

(c) a plurality of spool-like elements disposed in series on said axle rod, each of said spool-like elements having an internal diameter slightly greater than the external diameter of said axle rod, thereby being rotatable about said axle rod, and each of said spool-like elements being rotatable independently of the others;

(d) a spacer sleeve member interposed between at least two of said spool-like elements;

(e) at least one support arm longitudinally extending angularly upwardly from each of said spool-like elements to support a coat or other garment therefrom; and (f) each spool-like element above the lowermost said element being of a greater outside diameter than that immediately below it, and each support arm extending from the spool-like element above the lowermost such element, being of a greater longitudinal dimension that that of any of the arms extending from the spool-like element immediately below whereby garments on the several support arms on the different spool-like elements may be rotated about said axis for different angular dispositions relative to said rod, and garments hung on the upper support arms will not hang on the same vertical line as the garments hung on the lower support arms, thereby permitting garments hung on the support arm of any spool-like element to be rotated about the axle rod in a different concentric cylindrical path from that defined by the rotation of garments hung on the support arms of any other spool-like element.

2. The garment rack or stand as described in claim 1 wherein each spool-like element above the lowermost said element is of a greater diameter than that immediately below it, and each support arm extending from the spool-like element above the lowermost such element, is of a greater longitudinal dimension than that of the arm extending from the spool-like element immediately below; whereby garments hung on the upper support arms will not hang on same vertical line as the garments hung on the lower support arms.

3. The garment rack or stand as described in claim 1 wherein the axle rod may be rotated within the orifice in the base member.

4. The garment rack or stand as described in claim 1, wherein the axial rod may not be rotated within the orifice in the base member.

5. The garment rack or stand as described in claim 1, wherein at least one of the spacer elements is formed integrally with one of the adjacent spool-like elements.

6. The garment rack or stand as describe in claim 1, wherein each spool-like element is provided with at least one orifice upwardly angled from its outside wall, said orifice is threaded, and each support arm is matingly threadedly for insertion into said angular orifice.

7. The garment rack or stand as described in claim 1 wherein all parts are readily disassembled.

8. A clothes stand comprising:

(a) a base member, said member being at least partially axially orificed, from its top downwardly, said base member including means to support said base member on a horizontal surface with the axis of said orifice in a substantially vertical orientation;

(b) a cylindrical axle rod, said rod having a portion of a configuration to fit into the orifice in said base member, and being inserted therein;

(c) a plurality of spool-like elements disposed in series on said axle rod, each of said spool-like elements having an internal diameter slightly greater than the external diameter of said axle rod, thereby being rotatable about said axle rod, and each of said spool-like elements being rotatable independently of the others;

(d) a plurality of support arms longitudinally extending angularly upwardly from, and disposed equiangularly about, each of said spool-like elements to support a coat or other garment therefrom;

(e) each spool-like element above the lowermost said element being of a greater outside diameter than that immediately below it, and each support arm extending from the spool-like element above the lowermost such element, being of a greater longitudinal dimension than that of any of the arms extending from the spool-like element immediately below; and (f) the support arms extending from each spool-like element being vertically spaced from the arms extending from the adjacent spool-like element whereby garments on the several support arms on the different spool-like elements may be rotated about said axle rod for different angular dispositions relative to said axle rod, and garments hung on the upper support arms will not hang on the same vertical line as the garments hung on the lower support arms, thereby permitting garments hung on the support arm of any spool-like element to be rotated about the axle rod in a different concentric cylindrical path from that defined by the rotation of garments hung on the support arms of any other spool-like element.

* * * * *